US008877418B2

(12) United States Patent
Nakajima et al.

(10) Patent No.: US 8,877,418 B2
(45) **Date of Patent: *Nov. 4, 2014**

(54) DEVELOPING METHOD AND IMAGE FORMING METHOD

(75) Inventors: Hisashi Nakajima, Shizuoka (JP); Kimitoshi Yamaguchi, Shizuoka (JP); Shigenori Yaguchi, Shizuoka (JP); Hitoshi Iwatsuki, Shizuoka (JP); Toyoaki Tano, Shizuoka (JP); Mariko Takii, Shizuoka (JP); Minoru Masuda, Shizuoka (JP); Koichi Sakata, Shizuoka (JP); Saori Yamada, Shizuoka (JP); Hiroyuki Kishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

This patent is subject to a terminal disclaimer.

(21) Appl. No.: 13/185,941

(22) Filed: Jul. 19, 2011

(65) Prior Publication Data

US 2012/0028183 A1 Feb. 2, 2012

(30) Foreign Application Priority Data

Aug. 2, 2010 (JP) ..... 2010-173931
Jun. 30, 2011 (JP) ..... 2011-145251

(51) Int. Cl.
*G03G 15/06* (2006.01)
*G03G 9/113* (2006.01)
*G03G 9/107* (2006.01)

(52) U.S. Cl.
CPC ..... *G03G 9/1075* (2013.01); *G03G 9/1136* (2013.01); *G03G 9/1137* (2013.01); *G03G 9/107* (2013.01)
USPC ..... 430/123.58; 430/111.35

(58) Field of Classification Search
CPC .. G03G 9/1133; G03G 9/1136; G03G 9/1137
USPC ..... 430/123.58, 111.35
See application file for complete search history.

(56) References Cited

U.S. PATENT DOCUMENTS 5,698,357 A * 12/1997 Inoue et al. ..... 430/108.6
5,731,120 A * 3/1998 Tanigami et al. ..... 430/111.35

(Continued)

FOREIGN PATENT DOCUMENTS

JP 05224466 A * 9/1993 ..... G03G 9/113
JP 8-305090 11/1996

(Continued)

OTHER PUBLICATIONS

English language machine translation of JP 05-224466 (Sep. 1993).*

(Continued)

*Primary Examiner* — Christopher Rodee
(74) *Attorney, Agent, or Firm* — Oblon, Spivak, McClelland, Maier & Neustadt, L.L.P.

(57) ABSTRACT

The developing method includes developing an electrostatic latent image on an image bearing member with a two-component developer including a toner and a carrier and born on at least one developer bearing member, whose surface moves at a linear speed of from 300 mm/sec to 2,000 mm/sec. The carrier includes a particulate core material; and a cover layer located on a surface of the core material and including a crosslinked material obtained by crosslinking a resin including a first unit having a specific tris(trialkylsiloxy) silyl group and a second unit having a specific alkoxysilyl group having a crosslinking ability. Each of the first unit and the second unit is included in the resin in a molar ratio of from 0.1 to 0.9 based on all the units included in the resin.

9 Claims, 2 Drawing Sheets

(56) References Cited

U.S. PATENT DOCUMENTS

| | | | | |
|---|---|---|---|---|
| 6,620,570 | B2 * | 9/2003 | Kimoto et al. | 430/119.7 |
| 7,192,679 | B2 | 3/2007 | Yamaguchi et al. | |
| 7,468,233 | B2 | 12/2008 | Nagayama et al. | |
| 7,670,743 | B2 * | 3/2010 | Ohta et al. | 430/123.42 |
| 7,763,410 | B2 | 7/2010 | Yamaguchi et al. | |
| 8,475,989 | B2 * | 7/2013 | Takahashi et al. | 430/111.35 |
| 8,518,626 | B2 * | 8/2013 | Yamada et al. | 430/111.35 |
| 2003/0022087 | A1 * | 1/2003 | Tachi et al. | 430/108.7 |
| 2003/0054276 | A1 * | 3/2003 | Moriyama et al. | 430/106.2 |
| 2003/0059699 | A1 * | 3/2003 | Tachi et al. | 430/108.6 |
| 2003/0104297 | A1 * | 6/2003 | Matsuda et al. | 430/108.3 |
| 2006/0029435 | A1 * | 2/2006 | Kasai et al. | 399/267 |
| 2006/0210905 | A1 | 9/2006 | Imahashi et al. | |
| 2007/0048652 | A1 | 3/2007 | Imahashi et al. | |
| 2007/0243482 | A1 | 10/2007 | Yamaguchi et al. | |
| 2008/0063969 | A1 | 3/2008 | Yamaguchi et al. | |
| 2008/0227004 | A1 | 9/2008 | Yamaguchi et al. | |
| 2009/0092920 | A1 | 4/2009 | Nagayama et al. | |
| 2010/0233613 | A1 | 9/2010 | Masuda et al. | |
| 2010/0239975 | A1 | 9/2010 | Yamaguchi et al. | |
| 2011/0086307 | A1 | 4/2011 | Nakajima et al. | |
| 2011/0091802 | A1 * | 4/2011 | Takahashi et al. | 430/108.3 |
| 2011/0171573 | A1 | 7/2011 | Sakata et al. | |

FOREIGN PATENT DOCUMENTS

| | | |
|---|---|---|
| JP | 2010-140015 | 6/2010 |
| JP | 2010-244026 | 10/2010 |

OTHER PUBLICATIONS

U.S. Appl. No. 13/037,569, filed Mar. 1, 2001, Saori Yamada, et al.

U.S. Appl. No. 13/128,241, filed May 9, 2011, Minoru Masuda, et al.

* cited by examiner

DEVELOPING METHOD AND IMAGE FORMING METHOD

BACKGROUND OF THE INVENTION

1. Field of the Invention

The present invention relates to a developing method using a two-component developer. In addition, the present invention also relates to an image forming method using the developing method.

2. Description of the Related Art

Conventionally, electrophotographic image forming methods using a two-component developing method are known. The image forming methods typically include the following processes:

(1) Forming an electrostatic latent image on an image bearing member such as a photoreceptor;

(2) Developing the electrostatic latent image with a two-component developer including a toner and a carrier to form a toner image on the image bearing member;

(3) Transferring the toner image onto a recording material; and (4) Fixing the toner image on the recording material, resulting in formation of an output image.

A coated carrier having a configuration such that a cover layer, which includes a material having a low surface energy such as fluorine-containing resins and silicone resins, is located on the surface of a particulate core material is typically used as the carrier of the two-component developer.

There is a proposal for a carrier having a particulate magnetic core material and a cover layer, which is located on the surface of the core material and which includes a crosslinked resin obtained by crosslinking a copolymer, which is obtained by reacting an organopolysiloxane having a vinyl group at the end thereof with a radically polymerizable monomer having at least one functional group selected from the group consisting of hydroxyl, amino, amide and imide groups, using an isocyanate compound.

Recently, in order to produce high quality images, the diameter of toner used for the two-component developer becomes smaller and smaller. In addition, electrophotographic image forming methods have been used for print-on-demand fields, and there is a strong need for a super-high speed electrophotographic image forming apparatus having a higher print speed than conventional high-speed electrophotographic image forming apparatuses.

However, such a super-high speed electrophotographic image forming apparatus easily causes a problem in that the charging property and volume resistivity of the carrier used for the developer thereof seriously change, resulting in deterioration of image qualities.

For these reasons, the inventors recognized that there is a need for a carrier which does not cause the above-mentioned problem even when being used for super-high speed image forming apparatuses.

SUMMARY

This patent specification describes a novel developing method including developing an electrostatic latent image born on an image bearing member with a two-component developer, which includes a toner and a carrier and which is born on a developer bearing member whose surface moves at a linear speed of from 300 mm/sec to 2,000 mm/sec. The carrier includes a particulate core material and a cover layer formed on the surface of the core material. The cover layer includes a crosslinked material obtained by crosslinking a resin including a first unit having the below-mentioned formula (1) and a second unit having the below-mentioned formula (2):

(1)

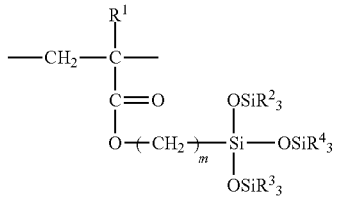

wherein $R^1$ represents a hydrogen atom or a methyl group, each of $R^2$, $R^3$ and $R^4$ represents an alkyl group having 1 to 4 carbon atoms, and m is an integer of from 1 to 8, wherein each of the three $R^2$ groups may be the same as or different from each other, each of the three $R^3$ groups may be the same as or different from each other, and each of the three $R^4$ groups may be the same as or different from each other; and (2)

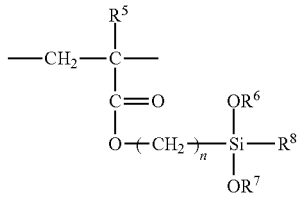

wherein $R^5$ represents a hydrogen atom or a methyl group, each of $R^6$ and $R^7$ represents an alkyl group having 1 to 4 carbon atoms, $R^8$ represents an alkyl group having 1 to 8 carbon atoms or an alkoxyl group having 1 to 4 carbon atoms, and n is an integer of from 1 to 8. Each of the first unit and the second unit is included in the resin in a molar ratio of from 0.1 to 0.9 based on all the units of the resin.

This patent specification further describes a novel image forming method, one embodiment of which includes forming an electrostatic latent image on an image bearing member; developing the electrostatic latent image using the above-mentioned developing method to form a toner image on the image bearing member; transferring the toner image to a recording material; and fixing the toner image to the recording material.

BRIEF DESCRIPTION OF THE DRAWINGS

A more complete appreciation of the aspects of the invention and many of the attendant advantage thereof will be readily obtained as the same better understood by reference to the following detailed description when considered in connection with the accompanying drawings, wherein.

DESCRIPTION OF THE PREFERRED EMBODIMENTS

Figure 1:
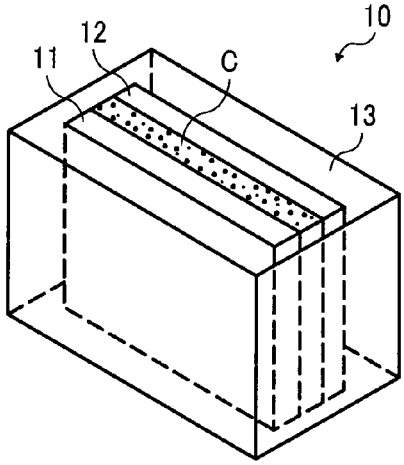
FIG. 1 is a schematic view illustrating a cell used for measuring the volume resistivity of a carrier.

Initially, the developing method of the present invention will be described.

The developing method of the present invention include developing an electrostatic latent image born on an image bearing member with a developer including a toner and a carrier and born on a developer bearing member. The surface of the developer bearing member is moved at a linear speed of from 300 mm/sec to 2,000 mm/sec. When the surface has a linear speed of less than 300 mm/sec, the stress applied to the developer in the developing device decreases, and thereby the surface of the carrier is easily contaminated with the toner or components constituting the toner, resulting in deterioration of the charging ability of the carrier, thereby causing a background development problem in that the background area of images is soiled with the toner and a toner scattering problem in that the toner in the developing device scatters and thereby the devices and parts in the vicinity of the developing device are contaminated with the toner.

In contrast, when the linear speed of the surface of the developer bearing member is greater than 2,000 mm/sec, the stress applied to the developer in the developing device increases, and the cover layer of the carrier is easily abraded, thereby decreasing the volume resistivity of the carrier, resulting in occurrence of a carrier adhesion problem in that particles of the carrier adhere to electrostatic latent images.

The carrier for use in the developer used for the developing method includes a particulate core material, and a cover layer located on the surface of the core material and including a crosslinked material obtained by crosslinking a resin including a first unit having the below-mentioned formula (1) and a second unit having the below-mentioned formula (2).

(1)

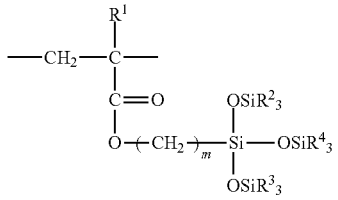

In formula (1), $R^1$ represents a hydrogen atom or a methyl group, each of $R^2$, $R^3$ and $R^4$ represents an alkyl group having 1 to 4 carbon atoms, and m is an integer of from 1 to 8, wherein each of the three $R^2$ groups may be the same as or different from each other, each of the three $R^3$ groups may be the same as or different from each other, and each of the three $R^4$ groups may be the same as or different from each other.

(2)

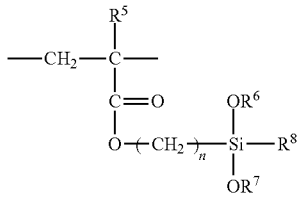

In formula (2), $R^5$ represents a hydrogen atom or a methyl group, each of $R^6$ and $R^7$ represents an alkyl group having 1 to 4 carbon atoms, $R^8$ represents an alkyl group having 1 to 8 carbon atoms or an alkoxyl group having 1 to 4 carbon atoms, and n is an integer of from 1 to 8.

Each of the first unit and the second unit is included in the resin in a molar ratio of from 0.1 to 0.9, and preferably from 0.3 to 0.7, based on all the constituent units of the resin.

The first unit having formula (1) includes a tris(trialkylsiloxy) silyl group, which has a low surface energy, in a side chain thereof. When the molar ratio of the first unit is less than 0.1, the surface energy of the cover layer increases, thereby often causing a spent toner problem in that the toner or the toner components adhere to the surface of the carrier, thereby deteriorating the charging ability of the carrier, resulting in occurrence of the above-mentioned background development problem and toner scattering problem. In contrast, when the molar ratio of the first unit is greater than 0.9, the cross-linkage density of the crosslinked material in the cover layer decreases, thereby often deteriorating the abrasion resistance of the cover layer of the carrier.

Specific examples of the monomers capable of forming the first unit (1) include, but are not limited thereto, 3-methacryloxypropyltris(trimethylsiloxy)silane, 3-acryloxypropyltris(trimethylsiloxy)silane, 4-methacryloxybutyltris(trimethylsiloxy)silane, 3-methacryloxypropyltris(triethylsiloxy)silane, 3-acryloxypropyltris(triethylsiloxy)silane, 4-methacryloxybutyltris(triethylsiloxy)silane, 3-methacryloxypropyltris(triisopropylsiloxy)silane, 3-acryloxypropyltris(triisopropylsiloxy)silane, 4-methacryloxybutyltris(triisopropylsiloxy)silane, and the like.

The method for preparing such a monomer for use in forming the first unit (1) is not particularly limited. For example, a method in which a tris(trialkylsiloxy) silane is reacted with allyl acrylate or allyl methacrylate in the presence of a platinum catalyst; a method disclosed in published unexamined Japanese patent applications No. JP-H11-217389-A in which a methacryloxyalkyltrialkoxysilane is reacted with a hexaalkyldisiloxane in the presence of a carboxylic acid and an acid catalyst; and the like. can be used.

The second unit (2) has a crosslinkable alkoxysilyl group in a side chain thereof. When the molar ratio of the second unit is less than 0.1, the cross-linkage density of the crosslinked material in the cover layer decreases, thereby often deteriorating the abrasion resistance of the cover layer of the carrier. In contrast, when the molar ratio of the second unit is greater than 0.9, the surface energy of the cover layer increases, thereby often causing the spent toner problem.

Specific examples of the monomers capable of forming the second unit (2) include, but are not limited thereto, 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltriisopropoxysilane, 3-acryloxypropyltriisopropoxysilane, etc.

Since the resin having the first unit (1) and the second unit (2) include alkoxysilyl groups in a high content, the cover layer including the resultant crosslinked material has a high cross-linkage density. In addition, since the crosslinked material is crosslinked by a siloxane bond, which has large bond energy, the crosslinked material has good resistance to heat stress, and therefore the cover layer has good abrasion resistance.

The resin having the first and second units (1) and (2) can further include a third unit having the following formula (3):

(3)

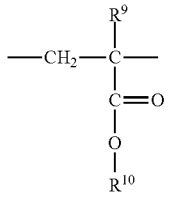

In formula (3), $R^9$ represents a hydrogen atom or a methyl group, and $R^{10}$ represents an alkyl group having 1 to 4 carbon atoms.

Specific examples of monomers capable of forming the third unit (3) include methyl methacrylate, methyl acrylate, ethyl methacrylate, ethyl acrylate, butyl methacrylate, butyl acrylate, 2-(dimethylamino) ethyl methacrylate, 2-(dimethylamino) ethyl acrylate, 3-(dimethylamino) propyl methacrylate, 3-(dimethylamino)propyl acrylate, 2-(diethylamino) ethyl methacrylate, 2-(diethylamino) ethyl acrylate, and the like. These monomers can be used alone or in combination for forming the third unit (3). Among these monomers, alkyl methacrylates are preferable, and methyl methacrylate is more preferable.

The method for preparing the cover layer including a crosslinked material is not particularly limited. For example, a method in which a crosslinkable composition including a resin having the first unit (1) and the second unit (2) is crosslinked can be used. In this regard, a silanol group, which is generated by hydrolyzing an alkoxysilyl group of the second unit (2), is subjected to a condensation reaction, thereby crosslinking the crosslinkable composition.

When the crosslinkable composition is crosslinked, the composition is preferably heated to a temperature of from 100° C. to 350° C. When the temperature is lower than 100° C., the crosslinking reaction does not satisfactorily proceed, resulting in deterioration of the mechanical strength of the cover layer including the crosslinked material. In contrast, when the temperature is higher than 350° C., the cover layer including the crosslinked material is easily oxidized, thereby deteriorating the charging property and mechanical strength of the cover layer.

The crosslinkable composition can further include a catalyst to accelerate the condensation reaction of the silanol groups generated by hydrolyzing alkoxysilyl groups of the second unit (2).

Suitable materials for use as the catalyst include titanium-containing catalysts, tin-containing catalysts, zirconium-containing catalysts, aluminum-containing catalysts, and the like, but are not limited thereto.

The crosslinkable composition preferably includes a particulate electroconductive material to adjust the volume resistivity of the carrier. Specific examples of the electroconductive material include carbon blacks, indium tin oxides (ITO), tin oxide, zinc oxide, and the like, but are not limited thereto. These materials can be used alone or in combination.

The weight ratio (EM/R) of the electroconductive material (EM) to the resin having the first and second units (R) is preferably from 0.001 to 10. When the weight ratio (EM/R) is less than 0.001, the resistivity adjustment effect can be insufficiently produced. In contrast, when the weight ratio (EM/R) is greater than 10, it becomes difficult for the cover layer to retain the electroconductive material therein.

The carrier preferably has a volume resistivity of from $1\times10^9$ Ω·cm to $1\times10^{17}$ Ω·cm. When the volume resistivity is lower than $1\times10^9$ Ω·cm, carrier particles often adhere to background areas (non-image areas) of images. In contrast, when the volume resistivity is higher than $1\times10^{17}$ Ω·cm, images with strong edge effect on an unacceptable level are often produced.

The volume resistivity of a carrier is measured using a cell 10 illustrated in FIG. 1. Specifically, a carrier C is contained in a container 13 of the cell 10, which is made of a fluorine-containing resin and which has electrodes 11 and 12, wherein each of the electrodes has a dimension of 2.5 cm×4 cm and the distance between the electrodes is 0.2 cm. After the carrier is fed into the container 13 so as to overflow from the container without applying a pressure to the carrier, the cell is tapped 10 times at a tapping speed of 30 times per minute and a tapping distance (height) of 1 cm, and a nonmagnetic flat blade is slid once along the upper surface of the container 13 to remove the carrier overflowing the container. Next, a DC voltage of 1,000V is applied between the electrodes 11 and 12, and the resistance r (Ω) of the carrier is measured at a time 30 seconds after applying the voltage using an instrument, HIGH RESISTANCE METER 4329A from Hewlett-Packard Japan, Ltd. The volume resistivity R (Ω·cm) of the carrier is determined from the following equation:

$$R(\Omega\cdot\text{cm})=r(2.5\times4)/0.2$$

The cover layer coating liquid for use in forming the cover layer can optionally include a silane coupling agent to stably disperse a particulate electroconductive material therein.

Specific examples of such a silane coupling agent, include, but are not limited thereto, 3-(2-aminoethylamino)propyltrimethoxysilane,
3-(2-aminoethylamino)propyldimethoxysilane,
3-methacryloxypropyltrimethoxysilane,
N-[2-(N-vinylbenzylamino)ethyl]-3-aminopropyltrimethoxysilane hydrochloride,
3-glycidoxypropyltrimethoxysilane,
3-mercaptopropyltrimethoxysilane, methyltrimethoxysilane,
methyltriethoxysilane, vinyltriacetoxylsilane,
3-chloropropyltrimethoxysilane, hexamethyldisilazane,
3-anilinopropyltrimethoxysilane, vinyltrimethoxylsilane,
octadecyldimethyl[3-(trimethoxysilyl)propyl]ammonium chloride, 3-chloropropylmethyldimethoxysilane,
methyltrichlorosilane, dimethyldichlorosilane,
trimethylchlorosilane, allyltrimethoxysilane,
3-aminopropylmethyldiethoxysilane,
3-aminopropyltrimethoxysilane, dimethyldiethoxysilane,
1,3-divinyltetramethyldisilazane,
methacryloxyethyldimethyl(3-trimethoxysilylpropyl)ammonium chloride, and the like. These silane coupling agents can be used alone or in combination.

Specific examples of marketed silane coupling agents include AY43-059, SR6020, SZ6023, SH6026, SZ6032, SZ6050, AY43-310M, SZ6030, SH6040, AY43-026, AY43-031, SH6062, Z-6911, SZ6300, SZ6075, SZ6079, SZ6083, SZ6070, SZ6072, Z-6721, AY43-004, Z-6187, AY43-021, AY43-043, AY43-040, AY43-047, Z-6265, AY43-204M, AY43-048, Z-6403, AY43-206M, AY43-206E, Z-6341, AY43-210MC, AY43-083, AY43-101, AY43-013, AY43-158E, Z-6920, and Z-6940, which are from Toray Silicone Co., Ltd.

The added amount of a silane coupling agent in the cover layer coating liquid is from 0.1% to 10% by weight based on the weight of the resin having the first and second units included in the coating liquid. When the added amount is less than 0.1% by weight, adhesion of the resin to a core material of the carrier and a particulate electroconductive material tends to deteriorate, resulting in peeling of the cover layer from the core material after long repeated use. In contrast, adding a silane coupling agent in an amount of greater than 10% by weight often causes the above-mentioned spent toner problem after repeated use.

The average thickness of the cover layer is preferably from 0.05 μm to 4 μm. When the thickness is less than 0.05 μm, the cover layer is easily damaged or worn out. In contrast, when the thickness is greater than 4 μm, the carrier adhesion problem is often caused because the cover layer itself is not a magnetic material and thereby magnetic attraction between the particles of the magnetic core material and a developer bearing member having a magnet therein decreases.

The core material is not particularly limited as long as the core material is a magnetic material. Specific examples of the core material include ferromagnetic metals such as iron and cobalt, iron oxides such as magnetite, hematite and ferrite, ferromagnetic alloys and compounds, particulate resins in which one or more of these magnetic materials are dispersed, and the like. Among these materials, manganese ferrite, manganese-magnesium ferrite and manganese-magnesium-strontium ferrite are preferable in view of environmental protection.

The core material preferably has a weight average particle diameter of from 20 μm to 65 μm. When the weight average particle diameter of the core material is less than 20 μm, the carrier adhesion problem is often caused. In contrast, when the weight average particle diameter is greater than 65 μm, reproducibility of fine line images tends to deteriorate, i.e., high definition images cannot be produced.

The weight average particle diameter of a core material is measured by a particle size analyzer, MICROTRACK HRA9320-X-100 from Nikkiso Co., Ltd.

The carrier of the present invention preferably has a magnetization of from 40 $Am^2$/kg to 90 $Am^2$/kg at a magnetic field of 1 kOe ($10^6/4\pi$ [A/m]). When the magnetization is lower than 40 $Am^2$/kg, the carrier adhesion problem is often caused. In contrast, when the magnetization is greater than 90 $Am^2$/kg, the magnetic brush formed on a developer bearing member becomes too hard, thereby forming low density images (because a part of a toner image formed on an image bearing member is scraped off by the magnetic brush). The magnetization of a carrier is measured by an instrument VSM-P7-15 from Toei Industry Co., Ltd.

The developer for use in the present invention includes the carrier mentioned above and a toner.

The toner is a monochrome toner (such as black toner) or a color toner (such as yellow, magenta and cyan toners), which includes at least a binder resin and a colorant. In order that the developer can be used for an oil-less fixing device, for which an oil for preventing adhesion of the toner to a fixing roller thereof is not used, the toner can further include a release agent. Such a toner tends to cause the spent toner problem in that a toner film is formed on the surface of the carrier used in combination with the toner, thereby degrading the charging ability of the carrier. However, since the carrier for use in the present invention can prevent occurrence of the spent toner problem, change of the charge quantity of the carrier and the volume resistivity can be controlled so as to be small even when the developer is used for super-high speed electrophotographic image forming apparatuses.

The binder resin of the toner is not particularly limited. Specific examples of resins for use as the binder resin of the toner include, but are not limited thereto, homopolymers of styrene and substituted styrene such as polystyrene, poly-p-chlorostyrene, and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene butadiene copolymers, styrene-isoprene copolymers, styrene maleic acid copolymers and styrene-maleic acid ester copolymers; acrylic resins such as polymethyl methacrylate, and polybutyl methacrylate; and other resins such as polyvinyl chloride polyvinyl acetate, polyethylene, polypropylene, polyester, polyurethane resins, epoxy resins, polyvinyl butyral resins, polyacrylic acid resins, rosin, modified rosins, terpene resins, phenolic resins, aliphatic or alicyclic hydrocarbon resins, aromatic petroleum resins, and the like. These resins are used alone or in combination.

Not only heat-fixable toner but also pressure-fixable toner can be used as the toner of the developer for use in the present invention. Specific examples of resins for use as the binder resin of such pressure-fixable toner include polyolefin (e.g., lowmolecular weight polyethylene and lowmolecular weight polypropylene), ethylene-acrylic acid copolymers, ethylene-acrylate copolymers, ethylene-methacrylic acid copolymers, ethylene-methacrylate copolymers, ethylene-vinyl chloride copolymers, ethylene-vinyl acetate copolymers, olefin copolymers (e.g., ionomer resins), epoxy resins, polyester resins, styrene-butadiene copolymers, polyvinyl pyrrolidone, methyl vinyl ether-maleic anhydride copolymers, maleic acid-modified phenolic resins, phenol-modified terpene resins, etc. These resins are used alone or in combination.

Specific examples of the yellow pigments include Cadmium Yellow, Mineral Fast Yellow, Nickel Titan Yellow, Naples Yellow, NEPHTHOL YELLOW S, HANZA YELLOW G, HANZA YELLOW 10G, BENZIDINE YELLOW GR, Quinoline Yellow Lake, PERMANENT YELLOW NCG, Tartrazine Lake, and the like.

Specific examples of the orange pigments include Molybdenum Orange, PERMANENT ORANGE GTR, Pyrazolone Orange, VULCAN ORANGE, INDANTHRENE BRILLIANT ORANGE RK, BENZIDINE ORANGE G, and INDANTHRENE BRILLIANT ORANGE GK.

Specific examples of the red pigments include red iron oxide, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, and Brilliant Carmine 3B.

Specific examples of the violet pigments include Fast Violet B, and Methyl Violet Lake.

Specific examples of the blue pigments include cobalt blue, Alkali Blue, Victoria Blue Lake, Phthalocyanine Blue, metal-free Phthalocyanine Blue, partially-chlorinated Phthalocyanine Blue, Fast Sky Blue, and INDANTHRENE BLUE BC.

Specific examples of the green pigment include Chrome Green, chromium oxide, Pigment Green B, and Malachite Green Lake.

Specific examples of the black pigments include carbon black, oil furnace black, channel black, lamp black, acetylene black, azine dyes such as aniline black, metal salts of azo dyes, metal oxides, and complex metal oxides.

These pigments can be used alone or in combination.

Specific examples of the release agent for use in the toner include polyolefin (e.g., polyethylene and polypropylene), fatty acid metal salts, fatty acid esters, paraffin waxes, amide waxes, polyalcohol waxes, silicone varnishes, carnauba waxes, ester waxes, and the like. These release agents can be used alone or in combination.

The toner can optionally include a charge controlling agent and a fluidity improving agent. Specific examples of the charge controlling agent include Nigrosine, azine dyes having 2 to 16 carbon atoms (disclosed in published examined Japanese patent application No. 42-1627), basic dyes, lake pigments of basic dyes, quaternary ammonium salts, dialkyltin compounds, dialkyltin borate compounds, guanidine derivatives, polyamine resins, metal complexes of monoazo dye-s, salicylic acid derivatives, metal complexes of acids, sulfonated copper phthalocyanine pigments, organic boron salts, fluorine-containing quaternary ammonium salts, calixarene compounds, and the like. These compounds can be used alone or in combination.

Specific examples of the basic dyes include C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000).

Specific examples of the quaternary ammonium salts include C.I. Solvent Black 8 (C.I. 26150), benzoylmethylhexadecylammonium chloride, and decyltrimethylammonium chloride.

Specific examples of the dialkyltin compounds include dibutyltin compounds, and dioctyltin compounds.

Specific examples of the polyamine resins include vinyl polymers having an amino group, and condensation polymers having amino group.

Specific examples of the metal complexes of monoazo dyes include metal complexes of monoazo dyes disclosed in published examined Japanese patent applications Nos. (hereinafter JP-B) 41-20153, 43-27596, 44-6397, and 45-26478.

Specific examples of the salicylic acid derivatives include compounds disclosed in JP-Bs 55-42752 and 59-7385.

Specific examples of the metal complexes of acids include metal (e.g., Zn, Al, Co, Cr and Fe) complexes of dialkylsalicylic acids, naphthoic acid, and dicarboxylic acids.

Among these charge controlling agents, salicylic acid derivatives (such as metal complexes) having white color are preferably used for color toners.

The fluidity improving agent to be included in the toner is not particularly limited.

Specific examples of the fluidity improving agent include particulate inorganic materials (such as silica, titanium oxide, alumina, silicon carbide, silicon nitride and boron nitride), particulate resins (such as polymethyl methacrylate and polystyrene) which are prepared by a soap-free emulsion polymerization method and which has an average particle diameter of from 0.05 μm to 1 μm, and the like. These materials are used alone or in combination.

Among these materials, metal oxides such as silica and titanium oxide, whose surface is hydrophobized, are preferable. It is more preferable to use a combination of a hydrophobized silica and a hydrophobized titanium oxide, wherein the added amount of hydrophobized silica is greater than that of the hydrophobized titanium oxide, so that the resultant toner can maintain good charge stability even when environmental humidity changes.

The method for preparing the toner for use in the developer is not particularly limited. Specific examples of the method include known methods such as pulverization methods, and polymerization methods.

Pulverization methods typically include the following processes:

(1) kneading toner components (such as a binder resin and a colorant) upon application heat and shearing force thereto;

(2) cooling the kneaded toner component mixture to solidify the mixture;

(3) pulverizing the solidified mixture;

(4) classifying the pulverized toner component mixture, thereby preparing toner particles (i.e., a mother toner); and (5) mixing a fluidity improving agent with the toner particles to improve the fluidity of the toner, resulting in preparation of a toner.

Specific examples of the kneading machines include batch kneading machines such as two-roll mills and BANBURY MIXER, and continuous kneaders such as twin screw extruders and single screw extruders. Specific examples of the twin screw extruders include KTK twin screw extruders from Kobe Steel, Ltd., TEM twin screw extruders from Toshiba Machine Co., Ltd., twin screw extruders from KCK Co., Ltd., PCM twin screw extruders from Ikegai Corp., KEX twin screw extruders from Kurimoto Ltd., etc. Specific examples of the single screw extruders include KO-KNEADER from Buss AG.

In the pulverization process, it is preferable to crush the solidified mixture using a crusher such as hammer mills, and cutter mills (e.g., ROATPLEX from Hosokawa Micron Corp.), and then pulverizing the crushed toner component mixture using a pulverizer such as jet air pulverizers and mechanical pulverizers. In this regard, it is preferable to perform pulverization so that the resultant toner particles have an average particle diameter of from 3 μm to 15 μm.

It is preferable to use an air classifier for the classification process. In the classification process, the toner particles are classified so as to have an average particle diameter of from 5 μm to 20 μm.

The fluidity improving agent addition process is performed using a mixer so that the added fluidity improving agent is adhered to the surface of the toner particles while dissociated.

The weight ratio (T/C) of the toner (T) to the carrier (C) in the developer for use in the present invention is generally from 3% (3/100) to 10% (10/100) by weight.

Figure 2:
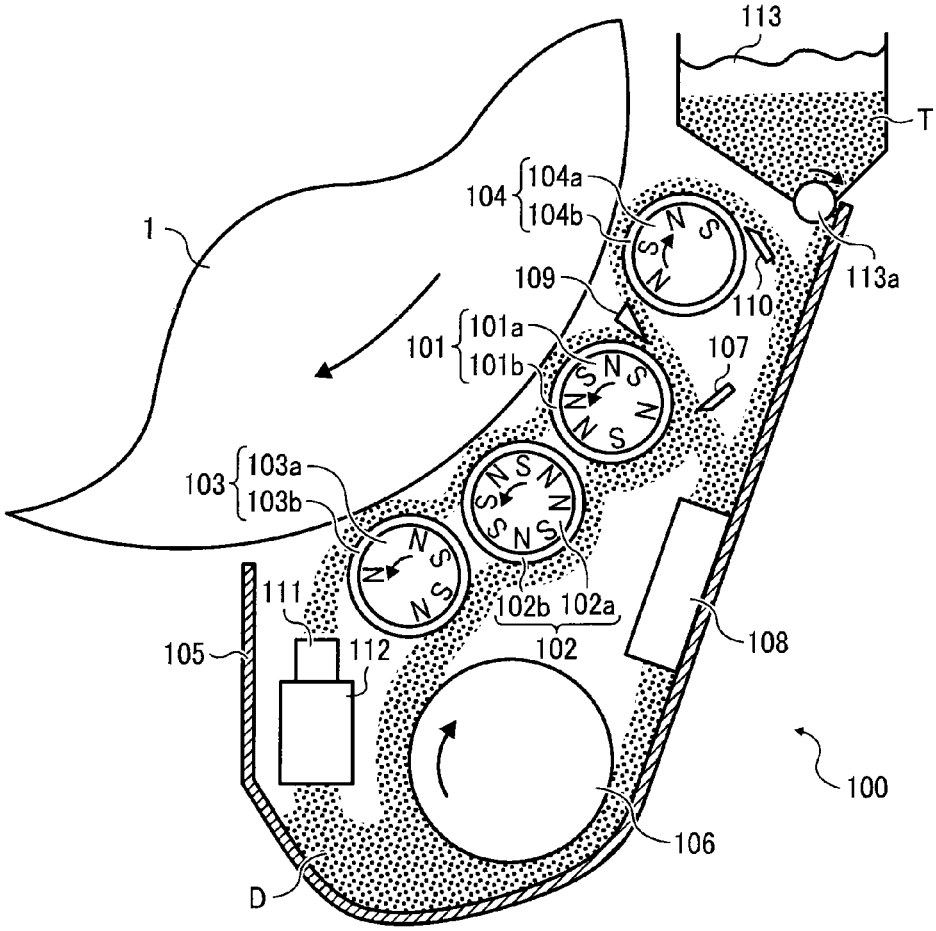
FIG. 2 is a schematic view illustrating a developing device for use in the developing method of the present invention.

FIG. 2 illustrates an example of the developing device for use in the developing method of the present invention.

Referring to FIG. 2, a developing device 100 is located in the vicinity of a photoreceptor 1 while opposed thereto. The developing device 100 includes a developer container 105, three backward developing rollers 101, 102 and 103 which are located in the vicinity of the photoreceptor 1 while opposed to the photoreceptor and which are rotated in a direction opposite to that of the photoreceptor 1, and a forward developing roller 104 which is located on an upstream side from the three backward developing rollers 101, 102 and 103 relative to the rotation direction of the photoreceptor 1 while opposed thereto and which is rotated in the same direction as that of the photoreceptor 1. The backward developing rollers 101, 102 and 103 respectively include magnets 101*a*, 102*a* and 103*a*, each of which has one or two pairs of two adjacent magnetic poles having the same polarity, wherein the other two adjacent magnetic poles have the opposite polarities. As illustrated in FIG. 2, the pair of two adjacent magnetic poles of the magnet 101*a* having the same polarity (N in this case) are located so as to be close to the roller 102, the two pairs of two adjacent magnetic poles of the magnet 102*a* having the same polarity (N and S in this case) are located so as to be close to the rollers 101 and 103, respectively, and the pair of two adjacent magnetic poles of the magnet 103*a* having the same polarity (S in this case) are located so as to be close to the roller 102. In this regard, the magnets 101*a*, 102*a* and 103*a* are fixed. In contrast, any two adjacent magnetic poles of a magnet 104*a* of the forward developing roller 104 have the opposite polarities. In this regard, the rotation speed of the surface of the forward developing roller 104 is the same as or slightly higher than that of the backward developing rollers 101, 102 and 103, and is in a range of from 300 mm/sec to 2,000 mm/sec.

Further, the developing device 100 has a developer feeding roller 106, which is located in the developer container 105 while opposed to the third backward developing roller 103 and which is rotated in a direction opposite to that of the backward developing roller 103. The developer feeding roller 106 has a magnetic attraction force to feed a developer D in the developer container 105 to the surface of the third backward developing roller 103, which is located on the downmost stream side relative to the rotation direction of the photoreceptor 1. The thus fed developer D is adhered to the surface of the third backward developing roller 103 due to the magnetic attraction force thereof. Since a sleeve 103*b* of the third backward developing roller 103 is rotated counterclockwise, the developer D adhered to the surface thereof is fed toward the upstream side, so that the developer D is attracted by the lower surface of the second backward developing roller 102. Similarly, since a sleeve 102*b* of the second backward developing roller 102 is rotated counterclockwise, the developer D adhered to the surface thereof is further fed toward the upstream side, so that the developer D is attracted by the lower surface of the first backward developing roller 101.

Furthermore, the thus fed developer D is fed to the gap formed by the first backward developing roller 101 and the forward developing roller 104 due to counterclockwise rotation of a sleeve 101*b* while the thickness of the developer D is controlled by a developer regulating blade 107, which is located below the first developing roller 101 to control the thickness of the developer so as to be a predetermined thickness (e.g., 2 mm in this case). In this regard, the developer scraped off by the developer regulating blade 107 falls in a cross mixer 108, which agitates the developer and returns the agitated developer to the lower portion of the developer container 105.

The developer D fed to the gap between the first backward developing roller 101 and the forward developing roller 104 is further fed to the upper surface of the forward developing roller 104 and the upper surfaces of the backward developing rollers 101, 102 and 103 to form developer layers thereon while controlling the amounts (thickness) of the developer layers so as to be, for example, 1 mm using a developer distribution blade 109. The developer fed to the backward developing rollers 101, 102 and 103 are used for developing an electrostatic image formed on the photoreceptor 1 in the opposite-direction developing regions formed by the photoreceptor 1 and the three backward developing rollers 101, 102 and 103. Thus, a toner image is formed on the surface of the photoreceptor 1.

The developer D passing the opposite-direction developing regions falls in a toner concentration detector 111 located below the third backward developing roller 103, followed by falling in another cross mixer 112 to be agitated and returned to the lower portion of the developer container 105.

Meanwhile, the developer separated from the developing roller 101 by the developer distribution blade 109 is adhered to the surface of the forward developing roller 104 while regulated by the developer distribution blade 109 so as to have a predetermined thickness (e.g., 1 mm in this case). The developer D thus fed to the forward developing roller 104 is used for developing an electrostatic image formed on the photoreceptor 1 in the same-direction development region formed by the photoreceptor 1 and the forward developing roller 104. The developer passing the same-direction development region is scraped off by a scraper 110 to fall in the cross mixer 108 to be agitated and returned to the lower portion of the developer container 105.

The toner concentration detector 111 outputs a signal depending on the concentration of the toner in the developer D. When the output signal level is lower than a predetermined level, a controller (not shown) rotates a feed roller 113*a* of a hopper 113, which is located on the developer exit side of the forward developing roller 104, to supply a supplementary toner T in the hopper 113 to the developer container 105. The thus supplied toner is fed into the cross mixer 108 to be mixed with the developer used for developing electrostatic latent images. The developer mixed with the supplementary toner T is agitated and contained in the developer container 105. When the signal output from the toner concentration detector 111 reaches the predetermined level, the controller stops the feed roller 113*a* so as not to supply the toner to the developer container 105.

Instead of the supplementary toner T, a supplementary developer including the toner and the carrier may be supplied from the hopper 113 to the developer container 105 while discharging a part of the developer D in the developer container 105. By using this developing method, the deteriorated carrier included in the developer D in the developer container 105 can be replaced with a fresh carrier while supplying the toner to the developer container. As a result, the charge quantity of the developer D in the developer container 105 can be stably maintained, thereby stably forming high quality images over a long period of time.

This developing method is particularly effective for a case in which images with a high image area proportion are produced and in which the spent toner problem is easily caused (namely, the carrier is easily deteriorated).

The supplementary developer includes the toner and the carrier mentioned above. However, the weight ratio (T/C) of the toner (T) to the carrier (C) is preferably from 2 to 50. When the ratio (T/C) is less than 2, the charge quantity of the developer considerably increases, resulting in decrease of the image density. In contrast, when the ratio is greater than 50, the carrier replacing effect is hardly produced.

Next, the image forming method will be described.

The image forming method of the present invention includes at least the following steps:

(1) forming an electrostatic latent image on an image bearing member;

(2) developing the electrostatic latent image with the developing method mentioned above to form a toner image on the image bearing member;

(3) transferring the toner image onto a recording material; and (4) fixing the toner image on the recording material.

Figure 3:
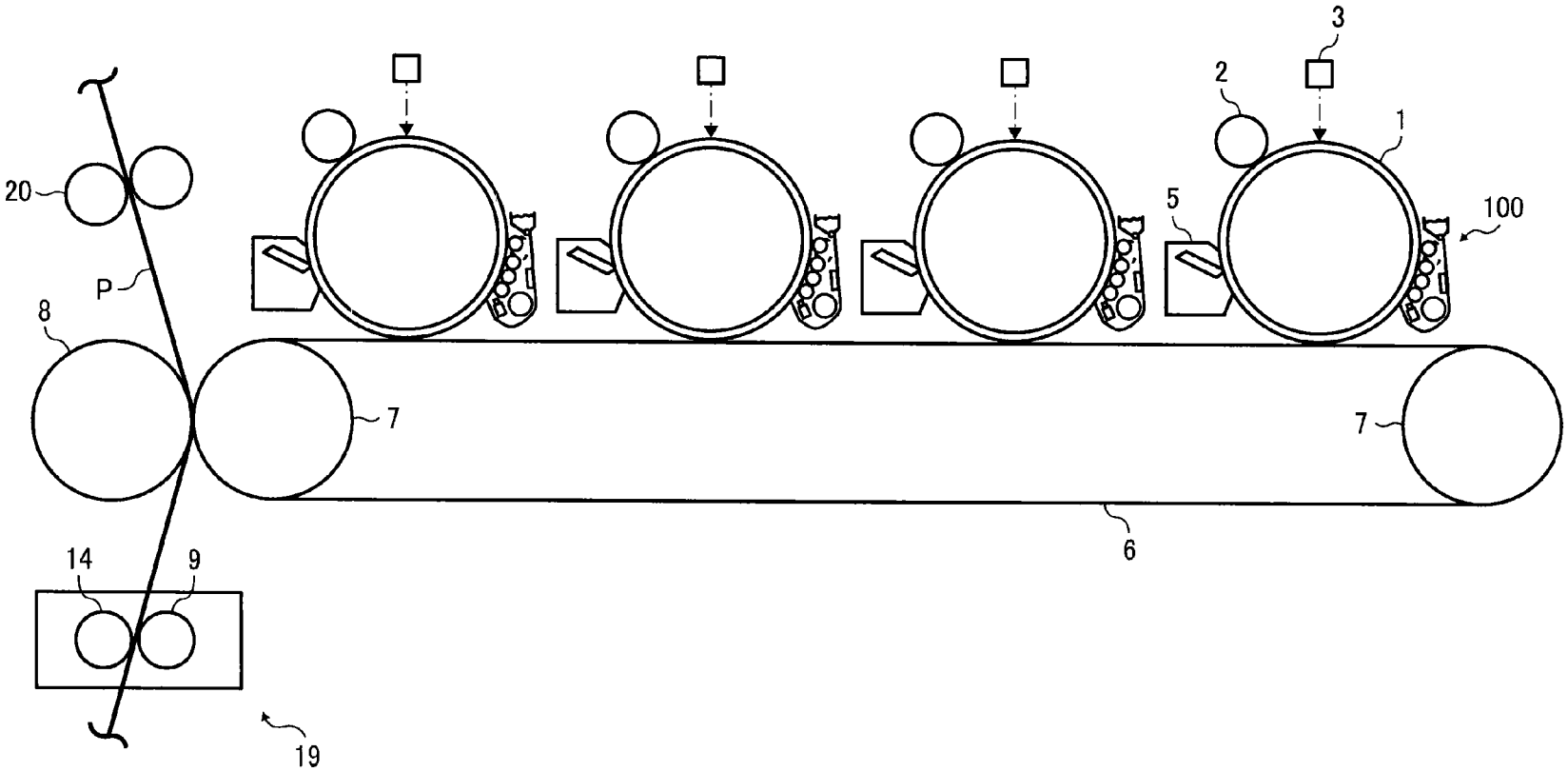
FIG. 3 is a schematic view illustrating an image forming apparatus for use in the image forming method of the present invention.

FIG. 3 illustrates an image forming apparatus (full color image forming apparatus) for use in the image forming method of the present invention.

Referring to FIG. 3, the full color image forming apparatus has four image forming units, each of which includes the image bearing member (photoreceptor) 1 rotated clockwise, and a charger 2, an irradiating device 3, the developing device 100 and a cleaner 5, which are provided in the vicinity of the image bearing member 1. In addition, the image forming apparatus includes an intermediate transfer medium 6, which is supported by the support rollers 7, and a transfer roller 8. The image forming apparatus further includes a sheet cassette (not shown) for containing plural sheets of a recording material P, a feeding roller for feeding the recording material sheet P, and a pair of registration rollers 20 for timely feeding the recording material sheet to a secondary transfer nip formed by the transfer roller 8 and the intermediate transfer medium 6. Furthermore, the image forming apparatus has a fixing device 19 having a heat roller 9 and a pressure roller 14.

Next, the full color image forming method of the image forming apparatus illustrated in FIG. 3 will be described.

Referring to FIG. 3, in each image forming unit, the charger 2 charges the image bearing member 1, which is clockwise rotated, and the irradiating device 3 irradiates the charged image bearing member 1 with laser light based on image data to form an electrostatic latent image on the image bearing member. The developing device 100 develops the electrostatic latent image with a developer including a color toner (i.e., a yellow, magenta, cyan or black toner). Thus, four different color toner images are formed on the image bearing members 1 are transferred one by one onto the intermediate transfer medium 6, resulting in formation of a combined color toner image on the intermediate transfer medium 6. The combined color toner image is transferred onto the recording material sheet P at the secondary transfer nip, and the recording material sheet P is then fed to the fixing device 19, resulting in fixation of the combined color toner image. Thus, a full color image is formed on the recording material sheet P.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Example

1. Preparation of Polyester Resin 1

The following components were fed into a reaction vessel equipped with a thermometer, an agitator, a condenser and a nitrogen feed pipe to be mixed.

| | |
|---|---|
| Propylene oxide adduct of bisphenol A (having hydroxyl value of 320 mmKOH/g) | 443 parts |
| Diethylene glycol | 135 parts |
| Terephthalic acid | 422 parts |
| Dibutyltin oxide | 2.5 parts |

The mixture was heated to 200° C. to be reacted. When the acid value of the reaction product reached 10 mgKOH/g, the reaction was stopped. Thus, a polyester resin 1 was prepared. It was confirmed that the polyester resin A has a glass transition temperature of 63° C. and a peak number average molecular weight of 6,000.

2. Preparation of Polyester Resin 2

The following components were fed into a reaction vessel equipped with a thermometer, an agitator, a condenser and a nitrogen feed pipe to be mixed.

| | |
|---|---|
| Propylene oxide adduct of bisphenol A (having hydroxyl value of 320 mmKOH/g) | 443 parts |
| Diethylene glycol | 135 parts |
| Terephthalic acid | 422 parts |
| Dibutyltin oxide | 2.5 parts |

The mixture was heated to 230° C. to be reacted. When the acid value of the reaction product reached 7 mgKOH/g, the reaction was stopped. Thus, a polyester resin 2 was prepared. It was confirmed that the polyester resin B has a glass transition temperature of 65° C. and a peak number average molecular weight of 16,000.

3. Preparation of Mother Toner

The following components were mixed for 3 minutes using a HENSCHEL MIXER mixer (HENSCHEL 20B from Mitsui Mining & Smelting Co., Ltd.) in which a rotor was rotated at a revolution of 1,500 rpm.

| | |
|---|---|
| Polyester resin 1 prepared above | 40 parts |
| Polyester resin 2 prepared above | 60 parts |
| Carnauba wax | 1 part |
| Carbon black (#44 from Mitsubishi Chemical Corp.) | 10 parts |

The mixture was kneaded using a single screw extruder, KO-KNEADER from Buss AG. The kneading conditions were as follows.

Preset temperature at entrance of the kneader: 100° C.

Preset temperature at exit of the kneader: 50° C.

Amount of the mixture fed to the kneader to be kneaded: 2 kg/hour

Thus, a kneaded toner component mixture A1 was prepared.

After being subjected to roll cooling, the kneaded toner component mixture A1 was pulverized using a pulverizer, followed by fine pulverization using an I-type mill (IDS-2 from Nippon Pneumatic Mfg. Co., Ltd.) using a flat collision plate, and classification using a classifier (132 MP from Alpine AG.). The fine pulverization conditions were as follows.

Pressure of air: 6.8 atm/cm$^2$

Fed amount of mixture to be pulverized: 0.5 kg/hour

Thus, a mother toner 1 was prepared.

4. Addition of External Additive

The following components were mixed using a HENSCHEL MIXER mixer.

| | |
|---|---|
| Mother toner 1 prepared above | 100 parts |
| Hydrophobized silica (R972 from Nippon Aerosil Co. ltd.) | 1.0 part |

Thus, a toner 1 was prepared.

CARRIER PREPARATION EXAMPLES

Synthesis of Resin 1 (Unit (1)/Unit (2)=5/5)

Initially, 500 g of toluene was fed into a flask equipped with an agitator, and heated to 90° C. under a nitrogen gas flow. Next, a mixture of the following components was dropped into the flask over 1 hour.

| | |
|---|---|
| 3-Methacryloxypropyltris(trimethylsiloxy)silane (i.e., component (1)) ($CH_2$═CMe—COO—$C_3H_6$—Si(OSiMe$_3$)$_3$, SILAPLANE TM-0701T from Chisso Corp.) | 211 g (500 mmole) |
| 3-Methacryloxypropyltrimethoxysilane (i.e., component (2)) ($CH_2$═CMe—COO—$C_3H_6$—Si(OMe)$_3$, | 124 g (500 mmole) |
| 2,2'-Azobis(2-methylbutylonitrile) (catalyst) | 0.58 g (3 mmole) |

Next, a solution of the catalyst, which had been prepared by dissolving 0.06 g (0.3 mmole) of 2,2'-azobis(2-methylbutylonitrile) in 15 g of toluene, was fed into the flask (i.e., the total added amount of 2,2'-azobis(2-methylbutylonitrile) is 0.64 g (3.3 mmole)). The mixture was heated for 3 hours in a temperature range of from 90 to 100° C. to perform a radical polymerization reaction. Thus, a solution of a resin 1 in which the molar ratio ((1)/(2)) of the component (1) to the component (2) is 5/5 was prepared.

The weight average molecular weight of the resin 1 was 35,000.

The solution was diluted with toluene so that the non-volatile content of the solution is 25% by weight. The viscosity of the diluted solution of the resin 1 was 8.5 $mm^2/s$, and the specific gravity thereof was 0.91.

Synthesis of Resin 2 (Unit (1)/Unit (2)=5/5)

The procedure for preparation of the resin 1 was repeated except that 124.0 g (500 mmole) of the component (2), 3-methacryloxypropyltrimethoxysilane, was replaced with 130 g (500 mmole) of 3-methacryloxypropylmethyldiethoxysilane ($CH_2$═CMe-COO—$C_3H_6$—SiMe $(OEt)_2$). Thus, a solution of a resin 2 in which the molar ratio ((1)/(2)) of the unit (1) to the unit (2) is 5/5 was prepared.

The weight average molecular weight of the resin 2 was 33,000.

The solution was diluted with toluene so that the non-volatile content of the solution is 25% by weight. The viscosity of the diluted solution of the resin 2 was 8.6=$^2$/s, and the specific gravity thereof was 0.92.

Synthesis of Resin 3 (Unit (1)/Unit (2)=9/1)

The procedure for preparation of the resin 1 was repeated except that the added amount of the component (1), 3-methacryloxypropyltris(trimethylsiloxy)silane, was changed from 211 g (500 mmole) to 379.8 g (900 mmole), and added amount of the component (2), 3-methacryloxypropyltrimethoxysilane, was changed from 124.0 (500 mmole) to 24.8 g (100 mmole). Thus, a solution of a resin 3 in which the molar ratio ((1)/(2)) of the unit (1) to the unit (2) is 9/1 was prepared. The weight average molecular weight of the resin 3 was 37,000.

The solution was diluted with toluene so that the non-volatile content of the solution is 25% by weight. The viscosity of the diluted solution of the resin 3 was 8.4 $mm^2/s$, and the specific gravity thereof was 0.92.

Synthesis of Resin 4 (Unit (1)/Unit (2)=1/9)

The procedure for preparation of the resin 1 was repeated except that the added amount of the component (1), 3-methacryloxypropyltris(trimethylsiloxy)silane, was changed from 211 g (500 mmole) to 42.2 g (100 mmole), and added amount of the component (2), 3-methacryloxypropyltrimethoxysilane, was changed from 124.0 (500 mmole) to 223.2 g (900 mmole). Thus, a solution of a resin 4 in which the molar ratio ((1)/(2)) of the unit (1) to the unit (2) is 1/9 was prepared.

The weight average molecular weight of the resin 4 was 34,000.

The solution was diluted with toluene so that the non-volatile content of the solution is 25% by weight. The viscosity of the diluted solution of the resin 4 was 8.7 $mm^2/s$, and the specific gravity thereof was 0.90.

Synthesis of Resin 5 (Unit (1)/Unit (2)=5/5)

The procedure for preparation of the resin 1 was repeated except that the component (1), 3-methacryloxypropyltris(trimethylsiloxy)silane, was replaced with 168.5 g (250 mmole) of another component (1), 4-acryloxybutyltris(tripropylsiloxy)silane having formula $CH_2$═CH—COO—$C_4H_8$—Si $(OSiPr_3)_3$, wherein Pr represents an isopropyl group, and the component (2), 3-methacryloxypropyltrimethoxysilane, was replaced with 83 g (250 mmole) of another compound (2), 3-methacryloxypropyltriisopropoxysilane having formula $CH_2$═$CCH_3$—COO—$C_3H_6$—Si$(OPr)_3$. Thus, a solution of a resin 5 in which the molar ratio ((1)/(2)) of the unit (1) to the unit (2) is 5/5 was prepared.

The weight average molecular weight of the resin 5 was 39,000.

The solution was diluted with toluene so that the non-volatile content of the solution is 25% by weight. The viscosity of the diluted solution of the resin 5 was 8.9 $mm^2/s$, and the specific gravity thereof was 0.94.

Synthesis of Resin 6 (unit (1)/unit (2)/unit (3)=2/1.5/6.5)

The procedure for preparation of the resin 1 was repeated except that the added amount of toluene was changed from 500 g to 300 g, the added amount of the component (1), 3-methacryloxypropyltris(trimethylsiloxy)silane, was changed from 211 g (500 mmole) to 84.4 g (200 mmole), the added amount of the component (2), 3-methacryloxypropyltrimethoxysilane, was changed from 124.0 g (500 mmole) to 37.2 g (150 mmole), and 65.0 g (650 mmole) of a component (3), methyl methacrylate ($CH_2$═CMe-COOMe), was added. Thus, a solution of a resin 6 in which the molar ratio ((1)/(2)/(3)) of the unit (1) and the unit (2) to the unit (3) is 2/1.5/6.5 was prepared.

The weight average molecular weight of the resin 6 was 34,000.

The solution was diluted with toluene so that the non-volatile content of the solution is 25% by weight. The viscosity of the diluted solution of the resin 6 was 8.7 $mm^2/s$, and the specific gravity thereof was 0.91.

Synthesis of Resin 7

The procedure for preparation of the resin 6 was repeated except that 37.2 g (150 mmole) of the component (2), 3-methacryloxypropyltrimethoxysilane, was replaced with 39.0 g (150 mmole) of another component (2), 3-methacryloxypropylmethyldiethoxysilane. The weight average molecular weight of the resin 7 was 33,000.

The solution was diluted with toluene so that the non-volatile content of the solution is 25% by weight. The viscosity of the diluted solution of the resin 7 was 8.8 $mm^2/s$, and the specific gravity thereof was 0.91.

Synthesis of Resin 8 (unit (1)/unit (2)=10/0)

The procedure for preparation of the resin 1 was repeated except that the added amount of the component (1), 3-methacryloxypropyltris(trimethylsiloxy)silane, was changed from 211 g (500 mmole) to 422 g (1.000 mmole), and the component (2), 3-methacryloxypropyltrimethoxysilane, was not added. Thus, a solution of a resin 8 in which the molar ratio ((1)/(2)) of the unit (1) to the unit (2) is 10/0 was prepared.

The weight average molecular weight of the resin 8 was 37,000.

The solution was diluted with toluene so that the non-volatile content of the solution is 25% by weight. The viscosity of the diluted solution of the resin 8 was 8.4 $mm^2/s$, and the specific gravity thereof was 0.91.

Synthesis of Resin 9 (Unit (1)/Unit (2)=0/10)

The procedure for preparation of the resin 1 was repeated except that the component (1), 3-methacryloxypropyltris(trimethylsiloxy)silane, was not added, and the added amount of the component (2), 3-methacryloxypropyltrimethoxysilane, was changed from 124 g (500 mmole) to 248 g (1.000 mmole). Thus, a solution of a resin 9 in which the molar ratio ((1)/(2)) of the unit (1) to the unit (2) is 0/10 was prepared.

The weight average molecular weight of the resin 9 was 33,000.

The solution was diluted with toluene so that the non-volatile content of the solution is 25% by weight. The viscosity of the diluted solution of the resin 9 was 8.7 $mm^2/s$, and the specific gravity thereof was 0.90.

Synthesis of Resin 10

One hundred (100) parts of methyl ethyl ketone was fed into a flask equipped with an agitator, a condenser, a thermometer, a nitrogen feed pipe and a dropping funnel and heated to 80° C. under a nitrogen gas flow. In addition, the following components were mixed to prepare a solution.

| | |
|---|---|
| Methyl methacrylate | 32.6 parts |
| 2-Hydroxyethyl methacrylate | 2.5 parts |
| 3-Methacryloxypropyltris(trimethylsiloxy)silane | 64.9 parts |
| 1,1'-azobis(cyclohexane-1-carbonitrile) (V-40 from Wako Pure Chemical Industries, Ltd.) | 1 part |
| Methyl ethyl ketone | 100 parts |

The solution was dropped into the flask over 2 hours while heating the flask to 80° C. under a nitrogen gas flow, followed by aging for 5 hours to perform a polymerization reaction.

Thus, a solution of a resin 10 was prepared.

The weight average molecular weight of the resin 10 was 45,000.

The solution was diluted with toluene so that the non-volatile content of the solution is 25% by weight. The viscosity of the diluted solution of the resin 10 was 9.4 $mm^2/s$, and the specific gravity thereof was 0.94.

Synthesis of Resin 11 (Unit (1)/Unit (3)=5/5)

The procedure for preparation of the resin 1 was repeated except that the component (2), 3-methacryloxypropyltrimethoxysilane, was replaced with 50 g (500 mmole) of methyl methacrylate (serving as a component (3)). Thus, a solution of a resin 11 in which the molar ratio ((1)/(3)) of the unit (1) to the unit (3) is 5/5 was prepared.

The weight average molecular weight of the resin 11 was 34,000.

The solution was diluted with toluene so that the non-volatile content of the solution is 25% by weight. The viscosity of the diluted solution of the resin 11 was 8.7 $mm^2/s$, and the specific gravity thereof was 0.91.

Synthesis of Resin 12 (Unit (2)/Unit (3)=5/5)

The procedure for preparation of the resin 1 was repeated except that the component (1), 3-methacryloxypropyltris(trimethylsiloxy)silane, was replaced with 50 g (500 mmole) of methyl methacrylate (serving as a component (3)). Thus, a solution of a resin 12 in which the molar ratio ((2)/(3)) of the unit (2) to the unit (3) is 5/5 was prepared.

The weight average molecular weight of the resin 12 was 32,000.

The solution was diluted with toluene so that the non-volatile content of the solution is 25% by weight. The viscosity of the diluted solution of the resin 12 was 8.5 $mm^2/s$, and the specific gravity thereof was 0.89.

Carrier Preparation Example 1

The following components were mixed to prepare a cover layer coating liquid having a solid content of 10% by weight.

| | |
|---|---|
| Resin 1 prepared above | 100 parts |
| Titanium diisopropoxybis(ethylacetoacetate) (catalyst, TC-750 from Matsumoto Fine Chemical Co., Ltd.) | 4 parts |
| Toluene | balance |

The above-prepared cover layer coating liquid was applied to a particulate manganese ferrite serving as a core material and having a weight average particle diameter of 35 μm, followed by drying at 70° C., using a fluidized bed coating device to form a cover layer on the manganese ferrite.

The coated carrier was then heated for 2 hours at 180° C. using an electric furnace.

Thus, a carrier of Example 1 was prepared.

Carrier Preparation Examples 2 to 7

The procedure for preparation of the carrier of Example 1 was repeated except that the resin 1 was replaced with each of the resins 2-7 prepared above.

Thus, carriers of Examples 2-7 were prepared.

Carrier Preparation Comparative Examples 1 and 2

The procedure for preparation of the carrier of Example 1 was repeated except that the resin 1 was replaced with each of the resins 8 and 9 prepared above.

Thus, carriers of Comparative Examples 1 and 2 were prepared.

Carrier Preparation Comparative Example 3

The resin 10 prepared above was mixed with a trimethylolpropane adduct of isophoronediisocyanate, which includes isocyanate groups in an amount of 6.1% by weight, in a molar ratio of 1/1, and the mixture was diluted with methyl ethyl ketone so as to have a solid content of 3% by weight. The thus prepared cover layer coating liquid was applied to a particulate manganese ferrite serving as a core material and having a weight average particle diameter of 35 μm, followed by drying at 70° C., using a fluidized bed coating device to form a cover layer on the manganese ferrite.

The coated carrier was then heated for 1 hour at 160° C. using an electric furnace.

Thus, a carrier of Comparative Example 3 was prepared.

Carrier Preparation Comparative Examples 4 and 5

The procedure for preparation of the carrier of Example 1 was repeated except that the resin 1 was replaced with each of the resins 11 and 12 prepared above.

Thus, carriers of Comparative Examples 4 and 5 were prepared.

Carrier Preparation Comparative Example 6

The procedure for preparation of the carrier of Example 1 was repeated except that 100 parts of the resin 1 was replaced with 30 parts of a methyl silicone resin, which had been prepared using a di-functional monomer and a tri-functional monomer and which has a weight average molecular weight of 15,000 and a solid content of 25% by weight.

Thus, a carrier of Comparative Example 6 was prepared.

These carriers were evaluated as follows.

1. Weight Average Particle Diameter (Dw) of Core Material

The weight average particle diameter of the core material of each carrier was measured using a particle size analyzer, MICROTRACK HRA9320-X100 from Nikkiso Co., Ltd.

2. Magnetization (M) at Magnetic Field of 1 KOe

The magnetization of each carrier was measured by an instrument VSM-P7-15 from Toei Industry Co., Ltd. Specifically, about 0.15 g of a carrier is fed into a cell having an inner diameter of 2.4 mm and a height of 8.5 mm, and the magnetization of the carrier is measured by the instrument at a magnetic field of 1 kOe.

3. Volume Resistivity (R)

The volume resistivity of each carrier was measured using the cell illustrated in FIG. 1. The method for measuring the volume resistivity of a carrier is mentioned above.

4. Average Thickness (h) of Cover Layer

The cross sections of particles of each carrier were observed with a transmission electron microscope (TEM) to determine thicknesses of 50 points of the resinous portions of the cover layer.

The average thickness (h) (in units of micrometer) of the cover layer was determined by averaging the 50 thickness data thus obtained.

The results are shown in Table 1.

TABLE 1

| Carrier | Copolymer used for cover layer | Weight average particle diameter (Dw) (μm) | Magnetization (M) ($Am^2/kg$) | Volume resistivity (logR (Ω · cm)) | Thickness of cover layer (μm) |
|---|---|---|---|---|---|
| Ex. 1 | Resin 1 | 36.0 | 62 | 15.5 | 0.20 |
| Ex. 2 | Resin 2 | 36.1 | 62 | 15.6 | 0.20 |
| Ex. 3 | Resin 3 | 36.3 | 62 | 15.7 | 0.21 |
| Ex. 4 | Resin 4 | 35.7 | 62 | 15.4 | 0.20 |
| Ex. 5 | Resin 5 | 36.6 | 62 | 15.6 | 0.20 |
| Ex. 6 | Resin 6 | 36.5 | 62 | 15.5 | 0.21 |
| Ex. 7 | Resin 7 | 36.4 | 62 | 15.4 | 0.20 |
| Comp. Ex. 1 | Resin 8 | 36.4 | 62 | 15.7 | 0.21 |
| Comp. Ex. 2 | Resin 9 | 35.6 | 62 | 15.4 | 0.20 |
| Comp. Ex. 3 | Resin 10 | 36.5 | 62 | 15.7 | 0.20 |
| Comp. Ex. 4 | Resin 11 | 35.5 | 62 | 15.6 | 0.21 |
| Comp. Ex. 5 | Resin 12 | 36.6 | 62 | 15.4 | 0.20 |
| Comp. Ex. 6 | Methyl silicone resin | 35.7 | 62 | 15.4 | 0.20 |

Developer Preparation Examples 1-7 and Developer Preparation Comparative Examples 1-6

Ninety three (93) parts of each of the carriers of Examples 1-7 and Comparative Examples 1-6 prepared above was mixed with 7.0 parts of the toner 1, and the mixture was subjected to ball milling for 20 minutes to prepare developers of Examples 1-7 and Comparative Examples 1-6 for developing electrostatic images.

The above-prepared developers were evaluated as follows.

I. Evaluation Using an Image Forming Apparatus in which the Surface of the Developing Roller is Rotated at a Speed of 320 Mm/Sec 1. Charge Quantity (Q)

Initially, each of the developers was subjected to a friction charging treatment and a blow-off treatment, in which the toner is removed from the developer using a blow-off type charge quantity measuring device (TB-200 from Toshiba Chemical Corp.) to measure the initial charge quantity (Q1) of each of the carriers in the developers.

In addition, after a running test in which 100,000 copies of an A-4 size original image having an image area ratio of 5% are produced was performed using each developer and an image forming apparatus, IMAGIO NEO C600 from Ricoh Co., Ltd., in which the surface of the developing roller is rotated at a speed of 320 mm/sec, the charge quantity (Q2) of each of the carriers in the developers was also measured using the blow-off type charge quantity measuring device to determine the charge quantity difference |Q1-Q2| of each carrier.

In this regard, the charge quantity difference |Q1−Q21 is preferably not greater than 10 μC/g. When the charge quantity difference is not greater than 10 μC/g, high quality images can be produced over a long period of time without causing the background development problem and the toner scattering problem.

2. Volume Resistivity (R)

The initial logarithmic volume resistivity (logR1) of each of the carriers was measured by the method mentioned above.

In addition, after the above-mentioned running test, the logarithmic volume resistivity (logR2) of the carrier, which was obtained by removing the toner from the developer used for the running test, was also measured to determine the logarithmic volume resistivity difference (logR1)−(logR2) of each carrier.

In this regard, the volume resistivity difference |(logR1)−(logR2)| is preferably not greater than 1.5. When the volume resistivity difference is not greater than 1.5 [ log Ω·cm], high quality images can be produced without causing the carrier adhesion problem in that carrier particles adhere to a solid image.

The evaluation results are shown in Table 2.

TABLE 2

| Developer | Q1 (−μC/g) | Q2 (−μC/g) | Q1-Q2 (−μC/g) | logR1 (Ω · cm) | logR2 (Ω · cm) | logR1-logR2 (Ω · cm) |
|---|---|---|---|---|---|---|
| Ex. 1 | 40 | 36 | 4 | 15.5 | 14.4 | 1.1 |
| Ex. 2 | 42 | 38 | 4 | 15.6 | 14.7 | 0.9 |
| Ex. 3 | 46 | 38 | 8 | 15.7 | 14.3 | 1.4 |
| Ex. 4 | 36 | 30 | 6 | 15.4 | 15.2 | 0.2 |
| Ex. 5 | 47 | 39 | 8 | 15.6 | 14.8 | 0.8 |
| Ex. 6 | 43 | 38 | 5 | 15.5 | 14.2 | 1.3 |
| Ex. 7 | 45 | 38 | 7 | 15.6 | 14.4 | 1.2 |
| Comp. Ex. 1 | 51 | 43 | 8 | 15.7 | 13.9 | 1.8 |
| Comp. Ex. 2 | 39 | 32 | 7 | 15.4 | 17.5 | −2.1 |
| Comp. Ex. 3 | 49 | 35 | 14 | 15.7 | 13.2 | 2.5 |
| Comp. Ex. 4 | 39 | 26 | 13 | 15.6 | 14.7 | 1.9 |
| Comp. Ex. 5 | 36 | 20 | 16 | 15.4 | 14.4 | 1.0 |
| Comp. Ex. 6 | 32 | 45 | −13 | 15.4 | 13.0 | 2.4 |

Referring to Table 2, both the charge quantity difference Q1-Q2 and the volume resistivity difference |(logR1)−(logR2)| of each of the developers of Examples 1-7 fall in the preferable ranges, but at least one of the charge quantity difference Q1−Q2 and the volume resistivity difference |(logR1)−(logR2)| of each of the developers of Comparative Examples 1-6 falls out of the preferable range.

II. Evaluation Using an Image Forming Apparatus in which the Surface of the Developing Roller is Rotated at a Speed of 1,000 mm/sec The above-mentioned method for evaluating the charge quantity and the volume resistivity of the developers of Examples 1-7 and Comparative Examples 1-6 was repeated except that the image forming apparatus used for the running test was changed to a super-high speed digital laser printer, modified version of IPSIO SP9500PRO manufactured by Ricoh Co., Ltd. The developing conditions of the printer were as follows.

(1) Rotation speed of surface of developing roller: 1,000 mm/sec (2) Development gap between surface of developing roller and surface of photoreceptor: 1.08 mm (3) Gap between doctor blade 109 and each of developing rollers 101 and 104: 1.4 mm (4) Reflection photo-sensor used for toner sensor: inactivated (5) Temperature in developing and transferring areas: 30-48° C.

In this regard, the charge quantity difference Q1−Q2 and the volume resistivity difference |(logR1)−(logR2)| are preferably not greater than 13 μC/g and not greater than 1.8 [ log Ω·cm], respectively.

The evaluation results are shown in Table 3.

TABLE 3

| Developer | Q1 (−μC/g) | Q2 (−μC/g) | Q1-Q2 (−μC/g) | logR1 (Ω · cm) | logR2 (Ω · cm) | logR1-logR2 (Ω · cm) |
|---|---|---|---|---|---|---|
| Ex. 1 | 44 | 37 | 7 | 15.5 | 14.1 | 1.4 |
| Ex. 2 | 45 | 38 | 7 | 15.6 | 14.5 | 1.1 |
| Ex. 3 | 49 | 41 | 8 | 15.7 | 14.1 | 1.6 |
| Ex. 4 | 40 | 28 | 12 | 15.4 | 15.0 | 0.4 |
| Ex. 5 | 50 | 40 | 10 | 15.6 | 14.3 | 1.3 |
| Ex. 6 | 44 | 34 | 10 | 15.5 | 14.1 | 1.4 |
| Ex. 7 | 50 | 38 | 12 | 15.6 | 14.2 | 1.4 |
| Comp. Ex. 1 | 52 | 42 | 10 | 15.7 | 13.2 | 2.5 |
| Comp. Ex. 2 | 41 | 26 | 15 | 15.4 | 17.7 | −2.3 |
| Comp. Ex. 3 | 53 | 37 | 16 | 15.7 | 13.0 | 2.7 |
| Comp. Ex. 4 | 41 | 27 | 14 | 15.6 | 13.2 | 2.4 |
| Comp. Ex. 5 | 43 | 26 | 17 | 15.4 | 13.9 | 1.5 |
| Comp. Ex. 6 | 46 | 30 | 16 | 15.4 | 12.6 | 2.8 |

Referring to Table 3, both the charge quantity difference Q1−Q2 and the volume resistivity difference |(logR1)−(logR2)| of each of the developers of Examples 1-7 fall in the preferable ranges, but at least one of the charge quantity difference Q1−Q2 and the volume resistivity difference |(logR1)−(logR2)| of each of the developers of Comparative Examples 1-6 falls out of the preferable range.

III. Evaluation Using an Image Forming Apparatus in which the Surface of the Developing Roller is Rotated at a Speed of 1,700 mm/sec The above-mentioned method for evaluating the charge quantity and the volume resistivity of the developers of Examples 1-7 and Comparative Examples 1-6 was repeated except that the image forming apparatus used for the running test was changed to a super-high speed digital laser printer, modified version of IPSIO SP9500PRO manufactured by Ricoh Co., Ltd. The developing conditions of the printer were as follows.

(1) Rotation speed of surface of developing roller: 1,700 mm/sec (2) Development gap between surface of developing roller and surface of photoreceptor: 1.26 mm (3) Gap between doctor blade 109 and each of developing rollers 101 and 104: 1.6 mm (4) Reflection photo-sensor used for toner sensor: inactivated (5) Temperature in developing and transferring areas: 30-48° C.

In this regard, the charge quantity difference Q1−Q2 and the volume resistivity difference |(logR1)−(logR2)| are preferably not greater than 15 μC/g and not greater than 2.0 [ log Ω·cm], respectively.

The evaluation results are shown in Table 4.

TABLE 4

| Developer | Q1 (−μC/g) | Q2 (−μC/g) | Q1-Q2 (−μC/g) | logR1 (Ω · cm) | logR2 (Ω · cm) | logR1-logR2 (Ω · cm) |
|---|---|---|---|---|---|---|
| Ex. 1 | 47 | 38 | 9 | 15.5 | 13.9 | 1.6 |
| Ex. 2 | 48 | 39 | 9 | 15.6 | 14.4 | 1.2 |
| Ex. 3 | 52 | 44 | 8 | 15.7 | 13.9 | 1.8 |
| Ex. 4 | 42 | 28 | 14 | 15.4 | 14.9 | 0.5 |
| Ex. 5 | 53 | 42 | 11 | 15.6 | 13.8 | 1.8 |
| Ex. 6 | 48 | 37 | 11 | 15.5 | 14.0 | 1.5 |
| Ex. 7 | 52 | 39 | 13 | 15.6 | 14.1 | 1.5 |
| Comp. Ex. 1 | 53 | 43 | 10 | 15.7 | 12.8 | 2.9 |
| Comp. Ex. 2 | 42 | 26 | 16 | 15.4 | 17.7 | −2.3 |
| Comp. Ex. 3 | 55 | 38 | 17 | 15.7 | 12.9 | 2.8 |
| Comp. Ex. 4 | 42 | 28 | 14 | 15.6 | 12.7 | 2.9 |
| Comp. Ex. 5 | 45 | 28 | 17 | 15.4 | 13.6 | 1.8 |
| Comp. Ex. 6 | 48 | 29 | 19 | 15.4 | 12.3 | 3.1 |

Referring to Table 4, both the charge quantity difference Q1−Q2 and the volume resistivity difference |(logR1)−(logR2)| of each of the developers of Examples 1-7 fall in the preferable ranges, but at least one of the charge quantity difference Q1−Q2 and the volume resistivity difference |(logR1)−(logR2)| of each of the developers of Comparative Examples 1-6 falls out of the preferable range.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2010-173931 and 2011-145251, filed on Aug. 2, 2010 and Jun. 30, 2011, respectively, the entire contents of which are herein incorporated by reference.

What is claimed is:

1. A developing method comprising:

developing an electrostatic latent image on an image bearing member with a two-component developer including a toner and a carrier wherein the two-component developer is born on plural developer bearing members, each of whose surfaces moves at a linear speed of from 300 mm/sec to 2,000 mm/sec, wherein the carrier includes:

a particulate core material; and a cover layer located on a surface of the core material and including a crosslinked material obtained by crosslinking a resin including a first unit having the below-mentioned formula (1) and a second unit having the below-mentioned formula (2):

(1)

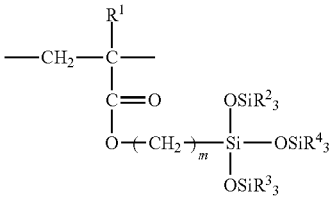

wherein $R^1$ represents a hydrogen atom or a methyl group, each of $R^2$, $R^3$ and $R^4$ represents an alkyl group having 1 to 4 carbon atoms, and m is an integer of from 1 to 8, wherein each of the three $R^2$ groups may be the same as or different from each other, each of the three $R^3$ groups may be the same as or different from each other, and each of the three $R^4$ groups may be the same as or different from each other; and (2)

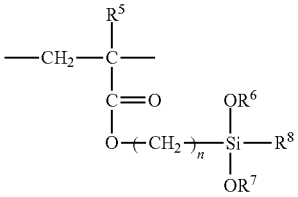

wherein $R^5$ represents a hydrogen atom or a methyl group, each of $R^6$ and $R^7$ represents an alkyl group having 1 to 4 carbon atoms, $R^8$ represents an alkyl group having 1 to 8 carbon atoms or an alkoxyl group having 1 to 4 carbon atoms, and n is an integer of from 1 to 8, wherein each of the first unit and the second unit is included in the resin in a molar ratio of from 0.1 to 0.9 based on all units included in the resin, and wherein the crosslinking is performed by formation of a siloxane bond.

2. The developing method according to claim 1, wherein the resin further includes a third unit having the following formula (3):

(3)

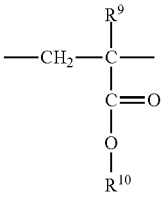

wherein $R^9$ represents a hydrogen atom or a methyl group, and $R^{10}$ represents an alkyl group having 1 to 4 carbon atoms.

3. The developing method according to claim 1, wherein the cover layer further includes a particulate electroconductive material.

4. The developing method according to claim 1, wherein the carrier has a volume resistivity of from $1\times10^9$ Ω·cm to $1\times10^{17}$ Ω·cm.

5. The developing method according to claim 1, wherein the cover layer has an average thickness of from 0.05 μm to 4 μm.

6. The developing method according to claim 1, wherein the particulate core material of the carrier has a weight average particle diameter of from 20 μm to 65 μm.

7. The developing method according to claim 1, wherein the carrier has a magnetization of from 40 $Am^2/kg$ to 90 $Am^2/kg$ at a magnetic field of 1 kOe.

8. The developing method according to claim 1, further comprising:

supplying a supplementary developer to the two-component developer while discharging part of the two-component developer while controlling a weight ratio of the toner to the carrier so as to fall in a predetermined range.

9. An image forming method comprising:

forming an electrostatic latent image on an image bearing member;

developing the electrostatic latent image by the developing method according to claim 1 to form a toner image on the image bearing member;

transferring the toner image to a recording material; and fixing the toner image to the recording material.

* * * * *